US005632048A

United States Patent [19]

Mortell et al.

[11] Patent Number: 5,632,048

[45] Date of Patent: May 27, 1997

[54] PROTECTOR HEARING HELMET

[75] Inventors: David Mortell, Malibu; Mark Andersen, Woodland Hills, both of Calif.; Lawrence A. Bernstein, Tucson, Ariz.

[73] Assignee: Protector Development, Malibu, Calif.

[21] Appl. No.: 531,111

[22] Filed: Sep. 20, 1995

[51] Int. Cl.[6] ..... A42B 3/00

[52] U.S. Cl. ..... 2/423; 2/424

[58] Field of Search ..... 2/410, 411, 414, 2/422, 423, 424, 425

[56] References Cited

U.S. PATENT DOCUMENTS

| | | | |
|---|---|---|---|
| 2,901,751 | 9/1959 | Gales et al. | 2/423 |
| 3,088,002 | 4/1963 | Heisig | 2/422 |
| 3,190,973 | 6/1965 | Aileo | 2/423 |
| 3,423,758 | 1/1969 | Heacox . | |
| 3,496,854 | 2/1970 | Feldmann et al. . | |
| 3,535,710 | 10/1970 | Aileo | 2/423 |
| 3,644,939 | 2/1972 | Beguin . | |
| 3,778,844 | 12/1973 | Hori et al. | 2/423 |
| 4,054,953 | 10/1977 | De Barsy . | |
| 4,103,359 | 8/1978 | Rieppel et al. . | |
| 4,114,197 | 9/1978 | Morton | 2/423 |
| 4,115,874 | 9/1978 | Hasegawa . | |
| 4,370,758 | 2/1983 | Matheis . | |
| 4,519,099 | 5/1985 | Kamiya et al. . | |
| 4,586,197 | 5/1986 | Hubbard . | |
| 4,622,700 | 11/1986 | Sundahl . | |
| 4,627,115 | 12/1986 | Broersma . | |
| 4,636,592 | 1/1987 | Scott . | |
| 4,665,569 | 5/1987 | Santini . | |
| 4,667,348 | 5/1987 | Sundahl . | |
| 4,698,856 | 10/1987 | Arai . | |
| 4,700,411 | 10/1987 | Kawasaki et al. . | |
| 4,704,746 | 11/1987 | Nava . | |
| 4,729,132 | 3/1988 | Fierro . | |
| 4,958,697 | 9/1990 | Moody . | |
| 4,977,975 | 12/1990 | Lazzeroni et al. . | |
| 5,086,785 | 2/1992 | Tichy . | |
| 5,138,722 | 8/1992 | Urella et al. . | |

FOREIGN PATENT DOCUMENTS

| | | |
|---|---|---|
| 76 13520 | 5/1976 | France . |
| 77 07447 | 3/1977 | France . |
| 77 34064 | 11/1977 | France . |
| 33 05 735 A1 | 2/1983 | Germany . |
| 90 13 217.3 | 9/1990 | Germany . |
| PCT/US92/ 07579 | 9/1992 | WIPO . |

*Primary Examiner*—Michael A. Neas
*Attorney, Agent, or Firm*—Cislo & Thomas LLP

[57] ABSTRACT

A helmet for use by riders of bicycles, motorcycles or other vehicles. Left and right hearing assemblies are mounted inside of the helmet. Each of the assemblies has an enclosed ear cup positioned to fit snugly over a respective one of the user's ears. Respective hearing conduits extend from the ear cups through the interior of the helmet to respective openings. Thereby while the ear cups block substantial wind noises, the hearing conduits direct desirable sounds, such as emergency sirens, other traffic noises and voices, to the user's ears. User operable actuators for closing and opening the hearing conduits as desired can be provided. Optional ventilation tubes direct cooling and drying air through openings in the ear cups to the user's ears. Gates or shutters supported by the helmet shell allow the user to open and dose the ventilation tubes as desired.

52 Claims, 6 Drawing Sheets

76
78
82
84
86
90
92
94
96
100
102
106
120
70
60
32

FIG. 5
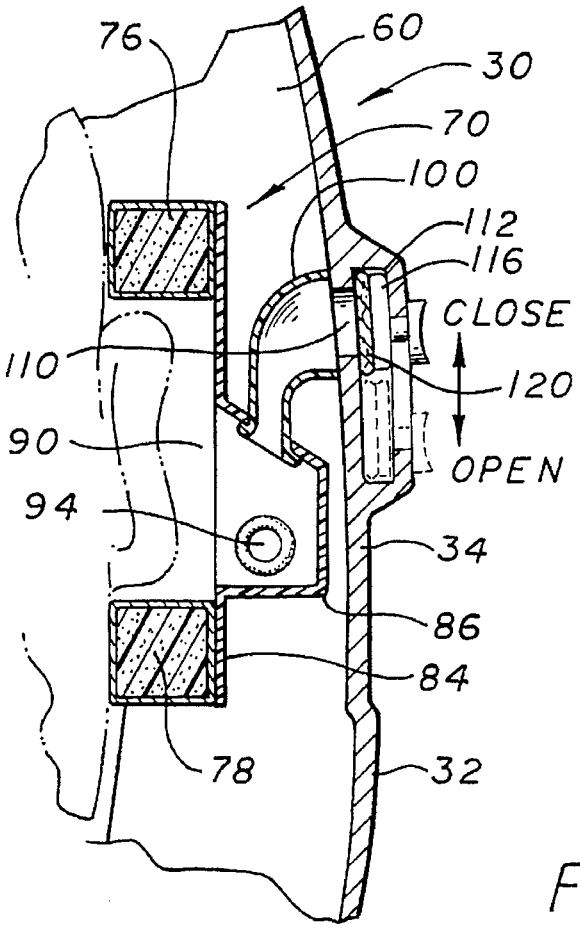
FIG. 7
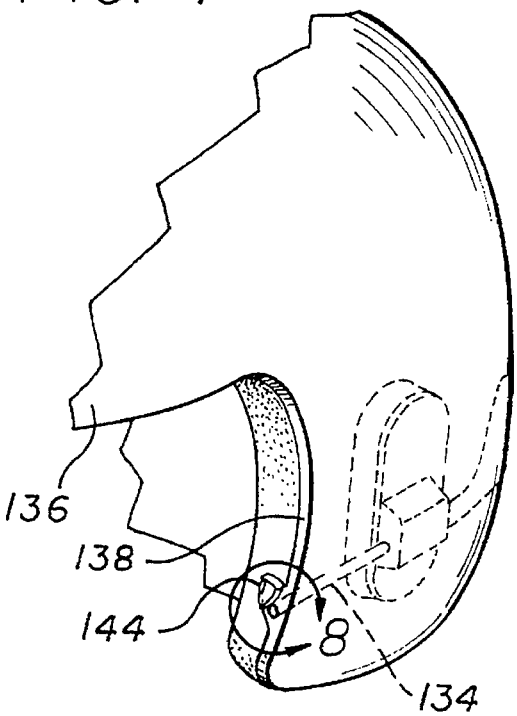
FIG. 8
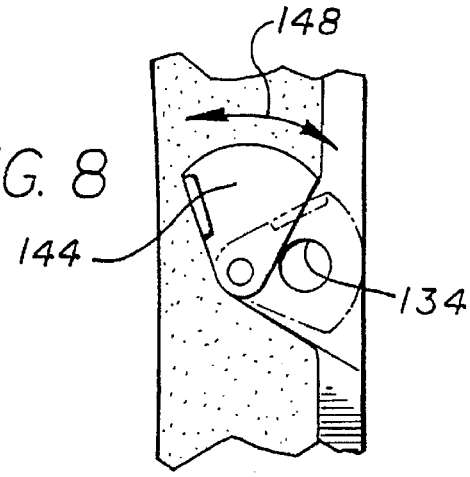
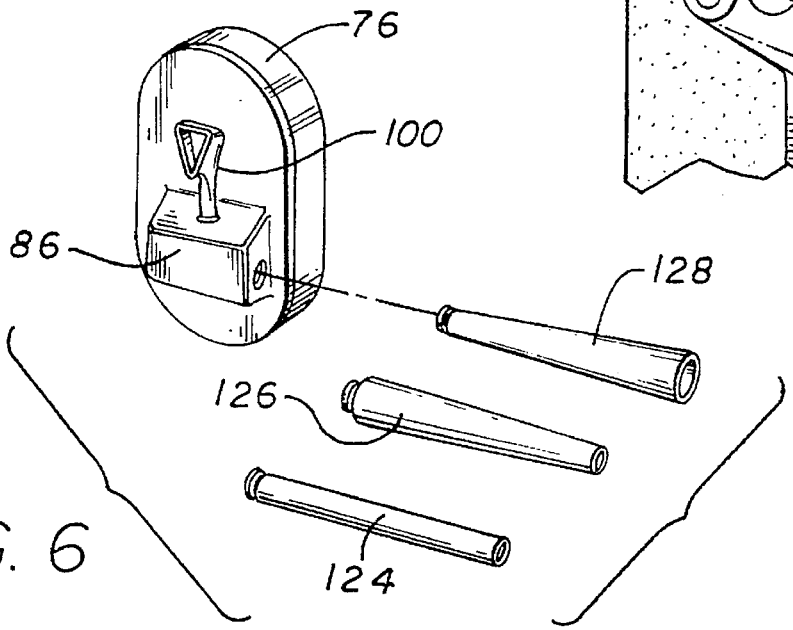
FIG. 6

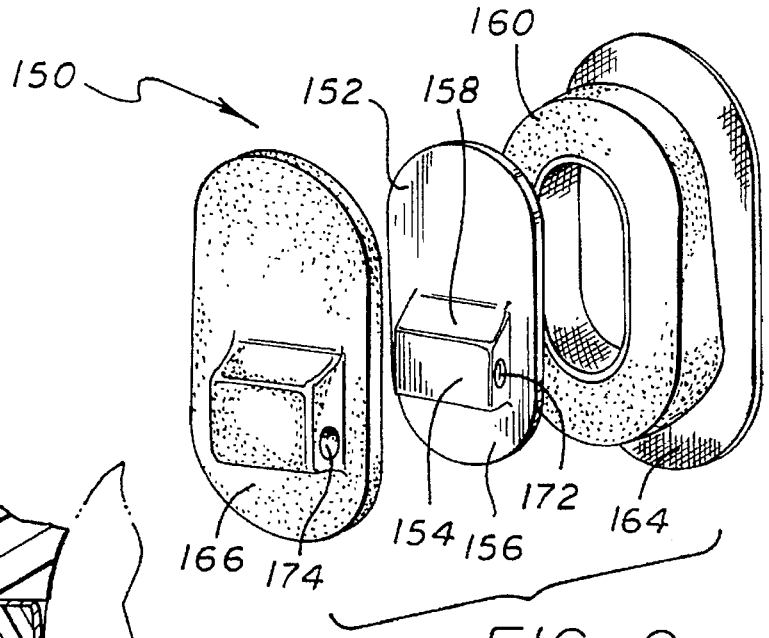
FIG. 9
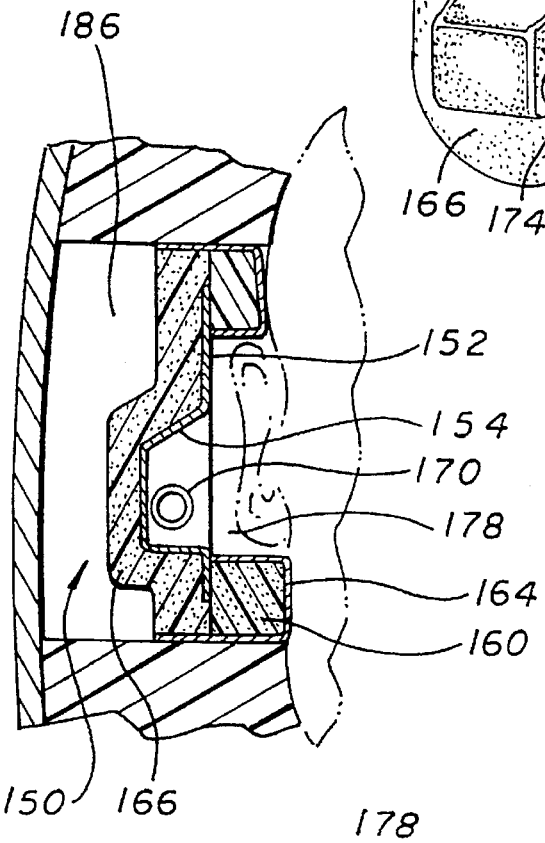
FIG. 10
FIG. 11
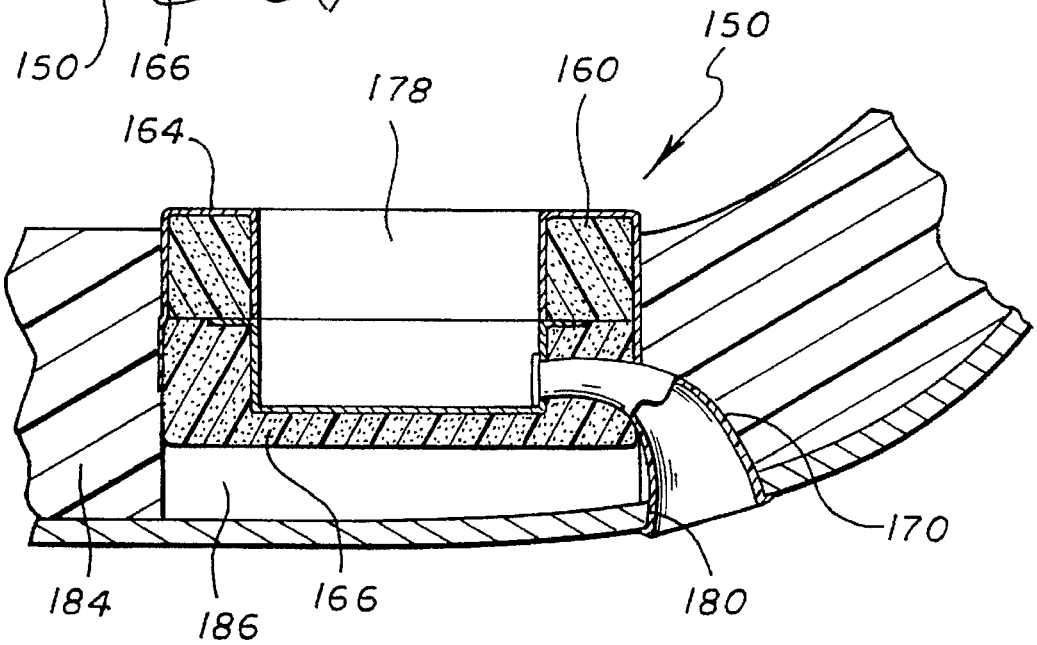

PROTECTOR HEARING HELMET

BACKGROUND OF THE INVENTION

The present invention relates generally to helmets worn by riders and passengers of bicycles, motorcycles, motorbikes and other vehicles and more particularly motorcycle helmets which by their use suffer from high wind noises.

The wind rushing by and against helmets and particularly those worn by motorcycle riders when traveling at fast speeds subjects the user to loud wind noises due to turbulence, laminar flow and so forth as the helmet passes through the air. These wind noises are not only annoying but under extreme conditions can actually injure the user's ears. Noise levels experienced at the ear of motorcyclists wearing prior art helmets vary depending on the helmet worn, whether or not it has a face shield, the motorcycle speed, the motorcycle brand, the helmet brand, and the amount of traffic. Noise levels of 100 decibels (or even 118 decibels) or more, even with some of the quieter helmets, at higher motorcycle speeds are not unusual. Noise levels higher than 85 decibels for long periods are potentially damaging to the ears. These noise levels exceed levels which allow speech communication or hearing of warning sounds. The noises are often so loud as to drown out or make difficult to hear sounds useful to the driver, such as honking and other sounds of nearby traffic, emergency vehicle sirens, people yelling out dangerous or upcoming traffic conditions, and conversations of adjacent riders.

Attempts in the past to remedy these problems have been only partially successful. For example, U.S. Pat. No. 4,370,758 shows a helmet having devices attached to the sides of the helmet to attenuate noise generated from turbulence as the helmet passes through the air. And U.S. Pat. No. 5,361,419 discloses breakaway air and sound ducts on the side of a helmet. (These two patents are hereby incorporated by reference in their entireties.)

SUMMARY OF THE INVENTION

Directed to remedying the problems in the prior art, an improved hearing helmet is herein provided. The helmet includes a helmet shell, crush liner material inside the shell, upholstery or fit pad material, and left and right hearing assemblies attached to the liner or fit pad material and on opposite sides within the shell. Each of the hearing assemblies includes a hearing cup positionable over a respective one of the user's ears and defining a hearing chamber over the ear, and a hearing tube or conduit. The conduit exits the cup and communicates the hearing chamber with the outside of the shell through a hole in the shell. While the heating cup sealed over the ear blocks the transmission of the wind noises on the shell to the ear, the hearing conduit still allows the user to hear traffic and other desirable sounds.

Each of the hearing assemblies has an ear cup including a cushion ring covered by a protective sheet with a cover plate on the outward side covering the ring opening. The ear cup is configured to fit around and over a respective ear of the user and to define a heating chamber adjacent the ear. A hearing conduit or tube passes to the hearing chamber at the tube proximal end and to a shell throughhole at the tube distal end. Traffic sounds and verbal communications thereby are funneled directly to the user's ears.

The user's ear enveloped by the ear cup can become hot and sweaty, being uncomfortable and distracting to the user. Optional ventilation tubes can be employed to remedy this problem. The tubes direct ventilating exterior air into the ear cups and thereby to the ears. The inlet ends of the tubes are preferably directed to the shell front or sides, as opposed to the rear, so that more air is blown into them and channeled to the ears. Gates or shutters operable by the user allow him to close off one or both ventilation tubes as desired.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 5 is an enlarged cross-sectional view taken on line 5—5 of FIG. 2, and showing the helmet in position on a user's head and one of his ears;

FIG. 6 is a perspective view of one of the hearing assemblies of the helmet of FIG. 1 showing in exploded relation three alternative hearing tubes;

FIG. 7 is a perspective view of a portion of an alternative helmet of the present invention;

FIG. 8 is an enlarged view taken on circle 8 of FIG. 7;

FIG. 9 is an exploded perspective view of an alternative heating assembly of the present invention;

FIG. 10 is a vertical sectional view of a portion of a further alternative helmet of the present invention including the heating assembly of FIG. 9;

FIG. 11 is a horizontal sectional view of a portion of a variation of the helmet of FIG. 10 using a side exiting hearing tube;

DETAILED DESCRIPTION OF THE PREFERRED EMBODIMENTS

Figure 1:
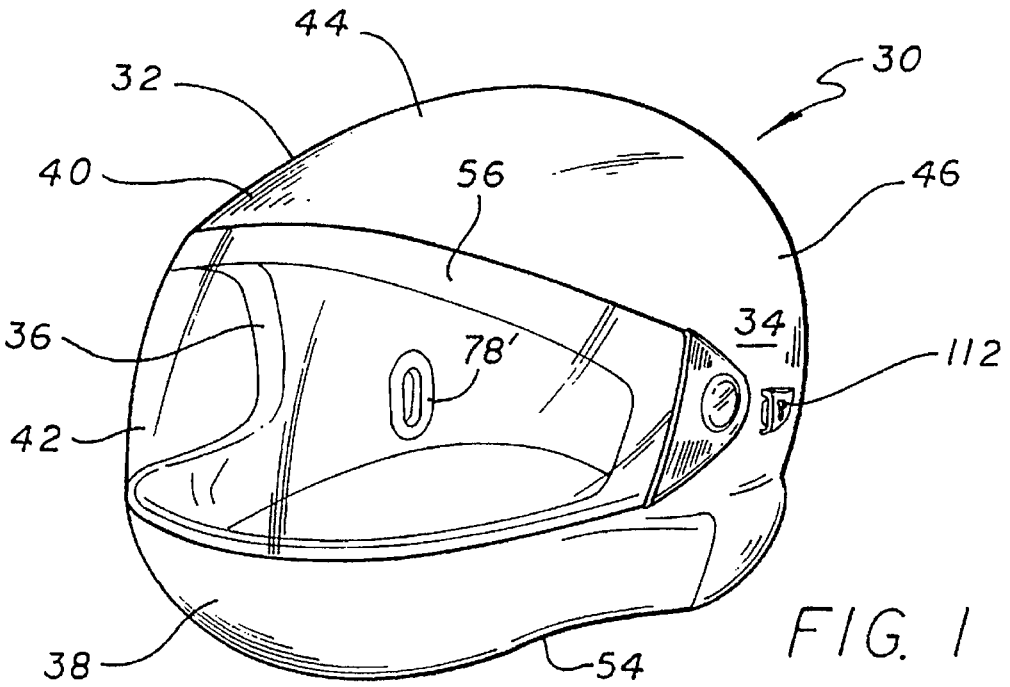
FIG. 1 is a front perspective view of a protector hearing helmet of the present invention.
Figure 2:
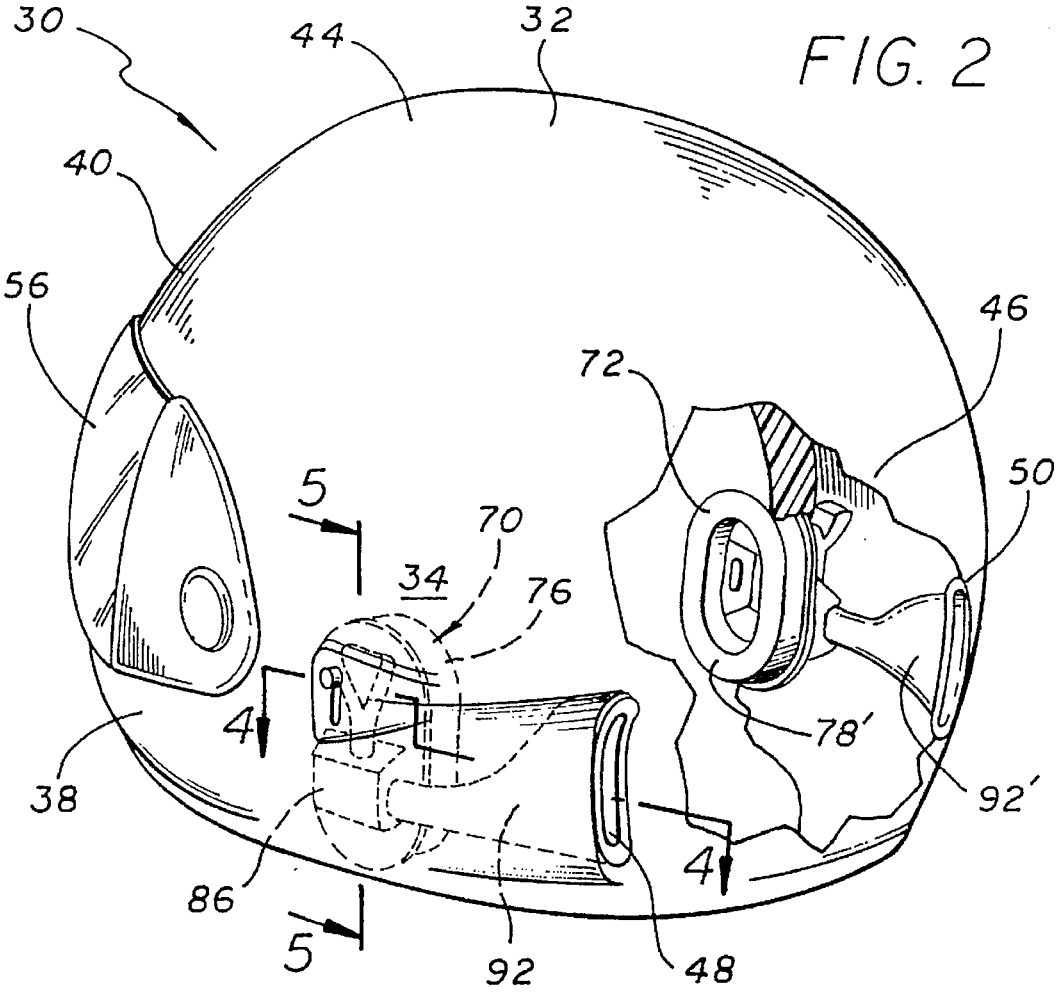
FIG. 2 is a rear perspective view of the helmet of FIG. 1 having portions broken away for illustrative purposes.

Referring to FIGS. 1 and 2, for example, a protector hearing helmet of the present invention is shown generally at 30. Helmet 30 as shown is particularly adapted for use by motorcyclists. However, different helmet constructions particularly adapted for different uses employing the concepts of this invention and as would be apparent to those skilled in the art from this disclosure are incorporated herein. Helmet 30 includes a helmet shell 32 made out of a lightweight, structurally strong material, such as fiber-reinforced high strength plastic, fiberglass, Kevlar or Kevlar-fiberglass blend, or polycarbonate. The helmet shell 32 has side portions 34, 36 which extend down over the user's ears, a bottom chin portion 38 which extends around the user's chin, a front portion 40 defining a user through-viewing area 42, a generally dome-shaped top portion 44, and a rear portion 46. The helmet shell 32 has a bottom opening 54 in through which the user's head is inserted. The helmet shell 32 is broadened out or protruded in the back about ¾ to 1½ inches compared with prior art helmets so that the hearing chambers can fit as will become apparent. The rest of shell 32 is configured to be smoothly integrated with the broadened back thereof. Slots 48, 50 are formed in the rear portion 46.

A face shield 56 made from a transparent material such as polycarbonate is pivotally coupled to the shell 32. The face shield 56 when in the operative down position covers the user through-viewing area 42 protecting the user's eyes and face from dust, debris and direct wind impact. The face shield 56 is shaped to generally match the curving shapes of the adjacent shell portions to optimize air flow thereover. The face shield 56 can be pivoted up when desired by the user.

A liner 60 is attached to inside surfaces of the shell 32 to cushion the user's head and prevent direct impact of his head against the hard shell. The liner 60 can be made of any suitable material, such as EPS foam or EPP memory foam. It for example can comprise an outer crush pad (EPS foam) layer against the shell 32 and an inner upholstery layer or fit pad which goes over the crush pad against the user's head.

Suspended from the liner 60 at both of shell side portions 34, 36 are a pair of left and right hearing assemblies, as shown in FIG. 2 generally at 70, 72. Since each is a mirror image of the other, the components and features of the right hearing assembly 70 will be denoted by the same reference numeral as those of the left but followed by a prime designation. Each of the assemblies 70, 72 is positioned within the shell 32 and is operatively over a respective one of the user's ears when the helmet 30 is in an operative position on a user's head. The construction and operation of the hearing assembly 70 will now be described.

Referring to FIGS. 2–5, the hearing assembly 70 is seen to comprise an ear cup shown generally at 76 snugly positionable over the user's ear. Ear cup 76 includes a flexible cushion ring 78 configured to fit over a user's ear, as depicted in dotted lines in FIG. 5. The ring 78 can be filled with oil, open-cell foam or elastomeric material. It can be covered with a sweat-absorbing cloth, a vinyl cover, or thin flexible plastic. The size of the ring 78 used depends on fit and comfort in each helmet model. For example, the outer diameter of the ring 78 can be 3¾ inches top to bottom and 3¼ inches side to side and the inner opening 82 can be three inches top to bottom and 2½ inches side to side. A hearing chamber cover member 84 is secured to the outside of the ring 78 and covers the ring opening 82. The cover member 84 can be made of plastic, ABS plastic, elastomer or rubber, and includes a protruding part 86 surrounded by a flat plate 88, as shown for example in FIG. 3. The protruding part 86 on the inside surface thereof together with the ring opening 82 define a hearing chamber 90 as illustrated in FIG. 5. The protrusion can be positioned anywhere inside the circumference of the hearing chamber and can be configured as desired.

Figures 3, 4:
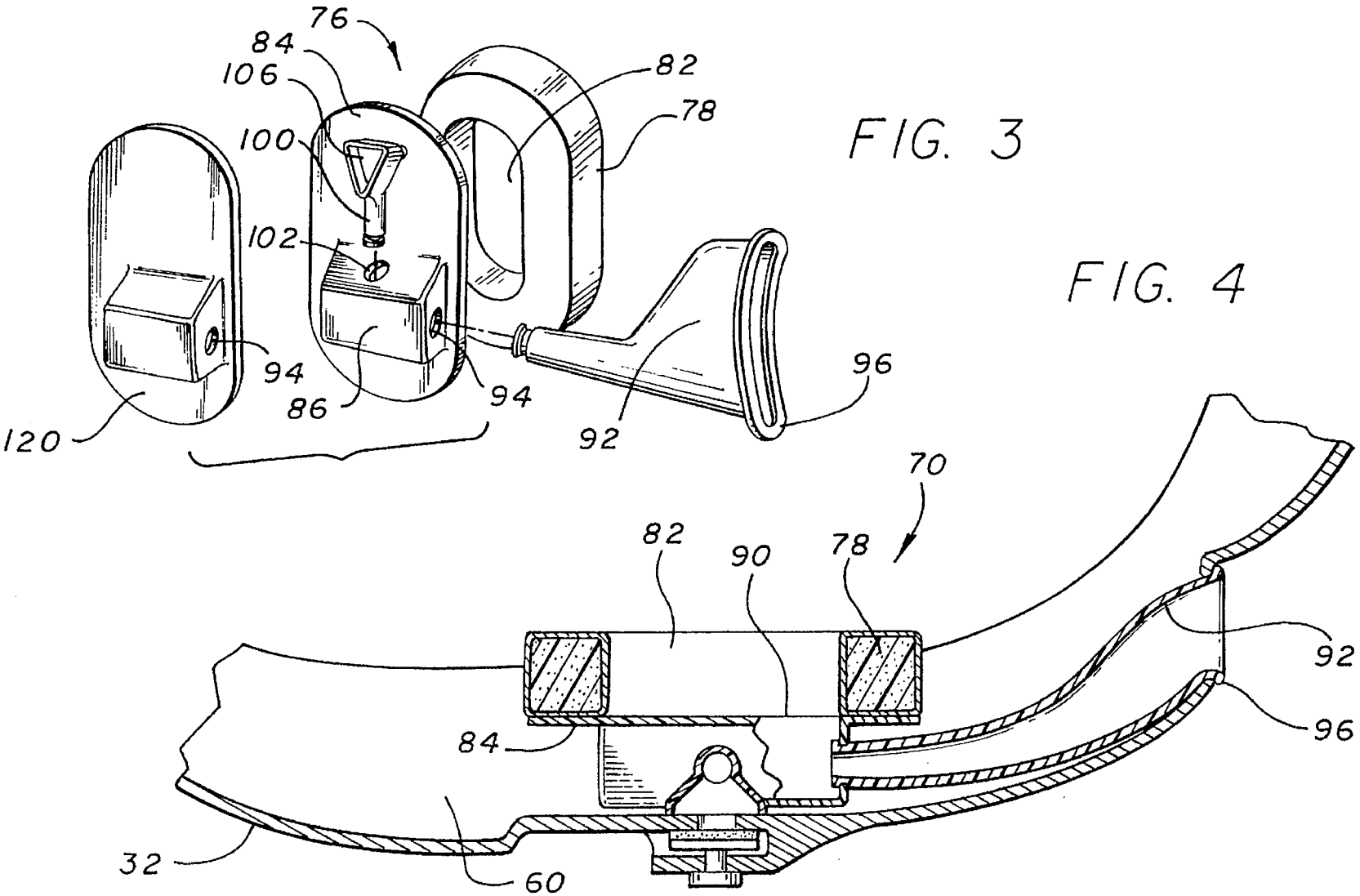
FIG. 3 is an enlarged exploded perspective view of the hearing assembly of the helmet of FIG. 1 illustrated in isolation and also showing an alternative ear cup plate.
FIG. 4 is an enlarged cross-sectional view taken on line 4—4 of FIG. 2.

A hearing conduit or tube 92 is secured into a rearward opening 94 in the protruding part 86. The distal end of the hearing conduit 92 is secured via its rim 96 to and in the opening 48 in the rear portion 46 of the shell 32. This is illustrated in FIG. 4. With this construction the ear cup 76 muffles or deadens the wind noises on the helmet 30, and the hearing conduit 92 allows traffic, voice and other desirable sounds to be directed into the shell 32, through the hearing conduit into the hearing chamber 90.

The ear covered by the ear cup 76 may become hot and sweaty. Accordingly, a unique vent tube 100 is provided fitted into a top opening 102 in the protruding part 86 as shown in FIG. 3. The vent tube 100 has a scoop 106 at its end fitted at a vent opening 110 in the shell 32 to direct cooling air from outside of the shell to the hearing chamber 90 and the ear. A breakaway (for safety reasons) housing 112 over the vent opening glued on the shell side includes a sliding shutter or button 116. The shutter 116, as depicted in FIG. 5, can be slid by the user up and down to open and close the vent opening 110 as desired. It is shown to have a sponge cover 120 to improve the closed sealing action. The vent tube 100 is snap fit, glued or otherwise secured to the top opening 102 in the protruding part 86 of the ear cup, as can be understood from FIGS. 3 and 5. The vent tube 100 is optional and need not be provided as illustrated by the alternative chamber cover member 120 shown on the left side of FIG. 3 without the top hole in the protruding portion 86 of the cover member. The protruding part still includes a rearward opening 94 for the hearing tube 92.

The heating tube 92 is horn shaped to better funnel outside sounds into the hearing chamber 90. However, other configurations of the hearing tube are within the scope of the invention as shown in FIG. 6 by alternative hearing tubes 124, 126 and 128. Hearing tube 124 is cylindrical and tubes 126 and 128 are conical shaped. While tube 126 converges towards the shell, tube 128 diverges thereto.

FIGS. 1–5 show the vent tube(s) 110 exiting out the helmet shell side(s). The vent tube 134 can alternatively exit out the front of the shell 136, at the front edge 138 of the shell, as shown in FIG. 7. The shell (and helmet) 136 of FIG. 7 is an open-face helmet, in contrast to that of FIG. 1. The vent tube 134 of FIG. 7 is straight cylindrical, in contrast to that of FIG. 5 which is a curved funnel shape. The vent tube 134 can be separate from or integrally formed on the inside surface of the shell 136 as illustrated in FIGS. 7 and 8. A tiny flapper valve or pivotal shutter 144 secured to the forward edge of the shell 136 or the tube 134 allows the vent tube to be opened or closed by the user as desired. That is, instead of axially sliding the shutter or valve 116 as in FIG. 5, a pivotal sliding of the shutter 144 provides the opening and closing action as shown by the arrow 148 in FIG. 8.

An alternative hearing assembly construction is shown in FIG. 9 generally at 150. The plastic cover plate 152 similarly includes a protruding part 154 surrounded by a flat plate rim 156 and having a rearward hearing tube opening 158. The cover plate 152 is glued or otherwise secured on the outward face of the ring 160. As shown in FIGS. 10 and 11, the plate 152 need not extend to the outer ring perimeter. A vinyl or cloth cover 164 or thin plastic seal or combination thereof is wrapped around the inside, inward, and outer faces of the ring 160 and up the outer faces of the sound deadening layer 166. Cover 164 encases and protects the hearing assembly and forms a clean user contact surface. The layer 166 is similarly shaped and configured as the outward surface of the cover plate 152 and glued or otherwise secured thereto, and can comprise medium-density closed cell foam with sound deadening properties. The hearing tube 170, as shown in FIG. 11, passes through a corresponding side opening 172 in the layer 166, through the cover plate opening and into the hearing chamber 178. The hearing tube 170 in FIG. 11 is illustrated as curving and short, flaring to an adjacent opening 180 in the shell side. Alternatively, the heating tube 170 can exit out the shell rear portion as shown in FIGS. 1–5. Although shown as exiting out a rearward opening in the cover plate in FIG. 11, it can exit out a lateral (or top, bottom or front) opening, as desired. It is also within the scope of the invention to provide two (or more) hearing tubes—both side and rear tubes, for example—for each hearing assembly.

The liner 184 in FIGS. 10 and 11 has an opening 186 for each of the hearing assemblies 150, such that an empty cavity is defined between the outward surface of the sound-deadening layer 166 and the inside of the shell 188. Alternatively, the cavity can be filled with (styrofoam) liner, other crushproof material, sound deadening material, or EPS foam; or layer 166 can lay into a molded internal cavity in the (EPS) liner. The application depends on the model helmet used.

Figure 13:
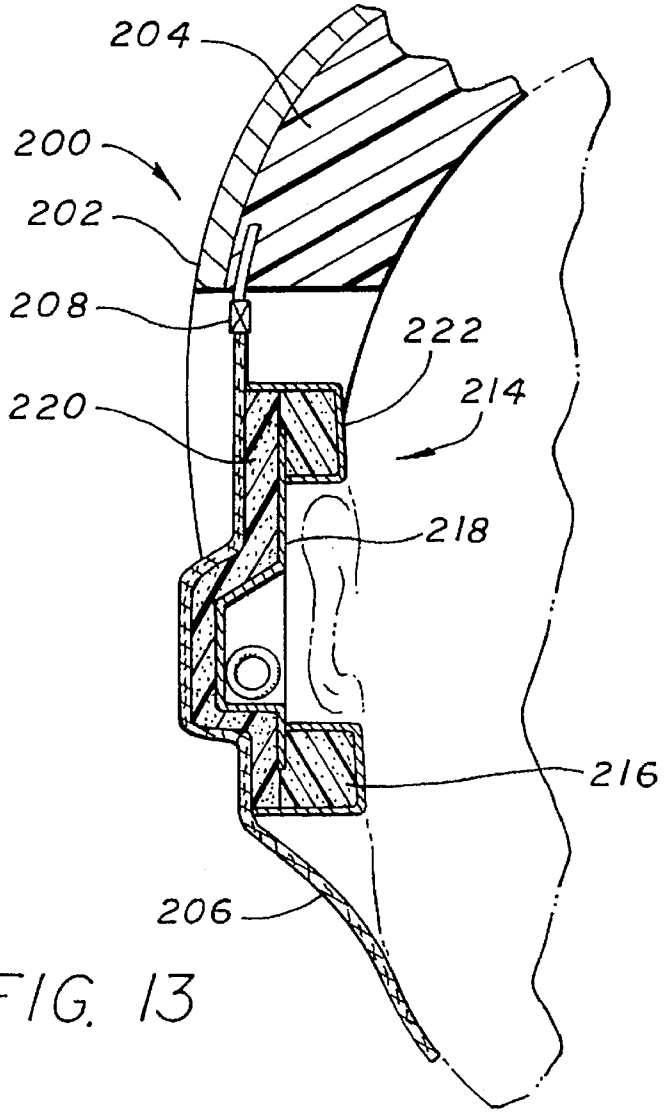
FIG. 13 is an enlarged sectional view taken on line 13—13 of FIG. 12.
Figure 12:
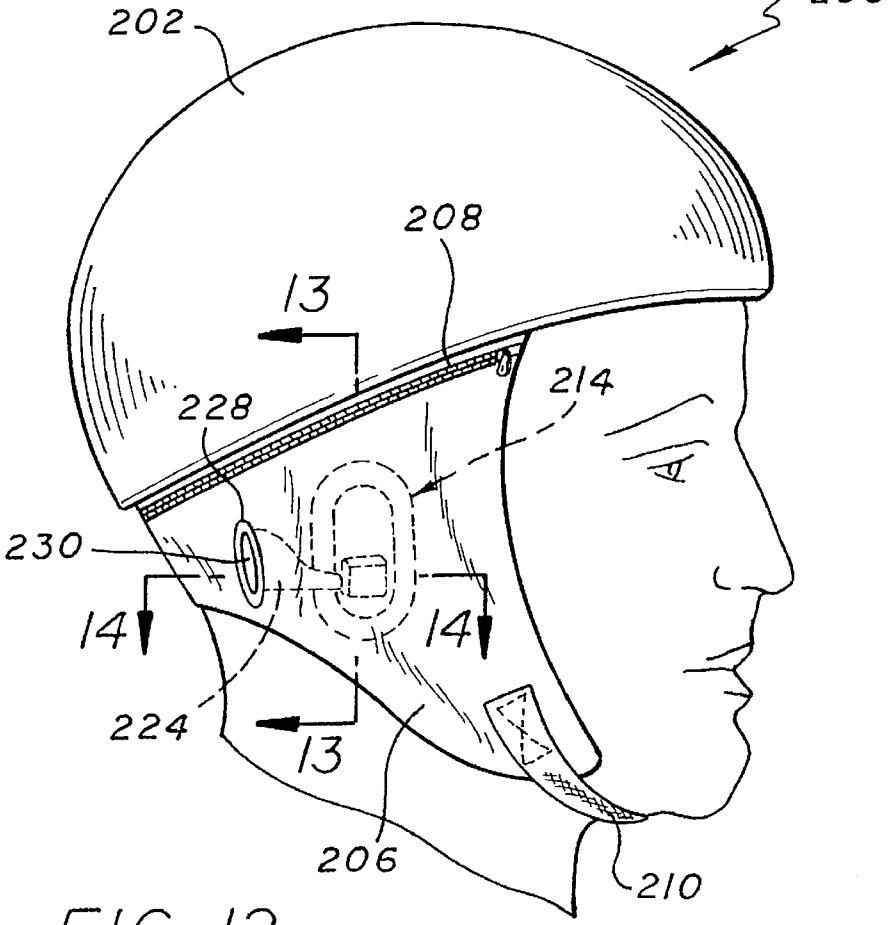
FIG. 12 is a side elevational view of another protector hearing helmet of the present invention shown in position on a user.
Figure 14:
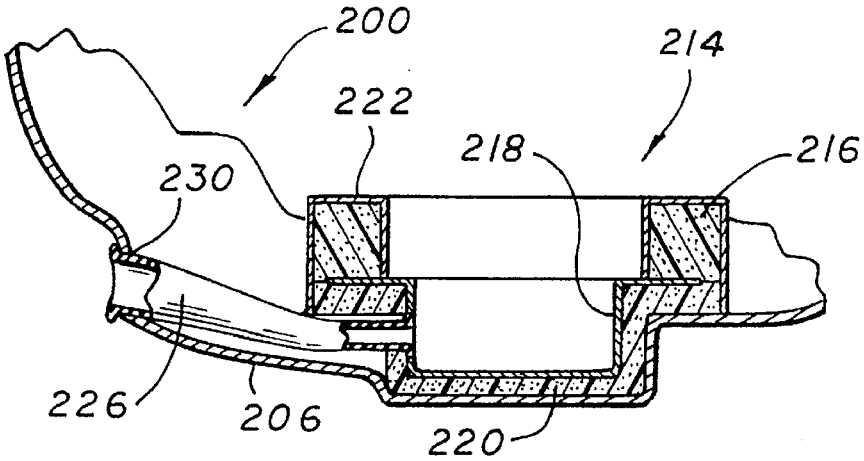
FIG. 14 is an enlarged sectional view taken on line 14—14 of FIG. 12.

FIGS. 12–14 show the general concepts of this invention used on a different style of helmet —a so-called "shorty" helmet. Helmet 200 includes a top shell 202 which stops above the user's ears, an EPS liner 204 and a side panel, skirt or curtain 206. The skirt 206 is zipped via zipper 208 onto the bottom of the shell 202 above the user's ears and extends down below his ears and behind his neck, as shown in FIG. 12. An adjustable chin strap 210 secures the skirt sides in place on his face. The skirt 206 can be removed and refastened from the helmet shell 202 using the zipper 208 at the user's option. The skirt 206 can be made out of vinyl, plastic or leather and can be filled with foam as desired. Any of the left and right hearing assemblies as disclosed anywhere in this disclosure can be adapted and used. One exemplary heating assembly is shown in FIGS. 12–14 generally at 214. It includes a ring 216, a cover plate 218, a sound-deadening foam layer 220, a cover 222, a hearing chamber 224 and a hearing tube 226, similar to those previously described. The distal rim end 228 of the hearing tube 226 is glued to the skirt 206 at a skirt opening 230, and the sound-deadening foam layer 220 is glued to the skirt 206. Hearing assembly 214 functions similar to the previously disclosed ones.

Figure 15:
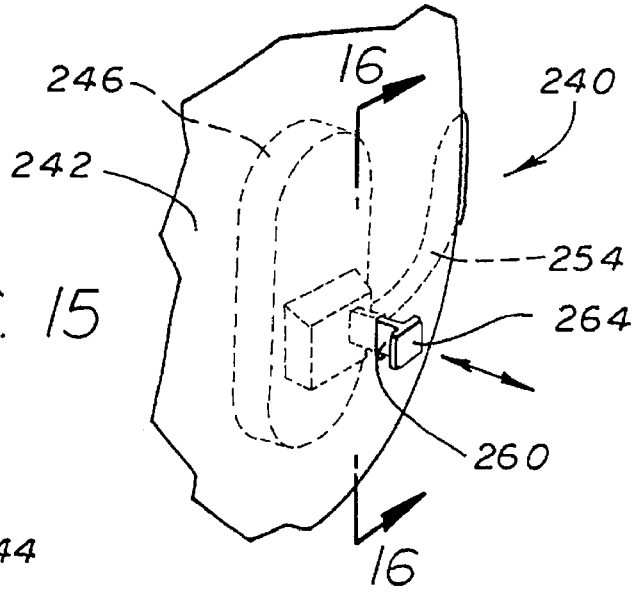
FIG. 15 is a perspective view of a portion of a still further helmet embodiment of this invention.
Figure 16:
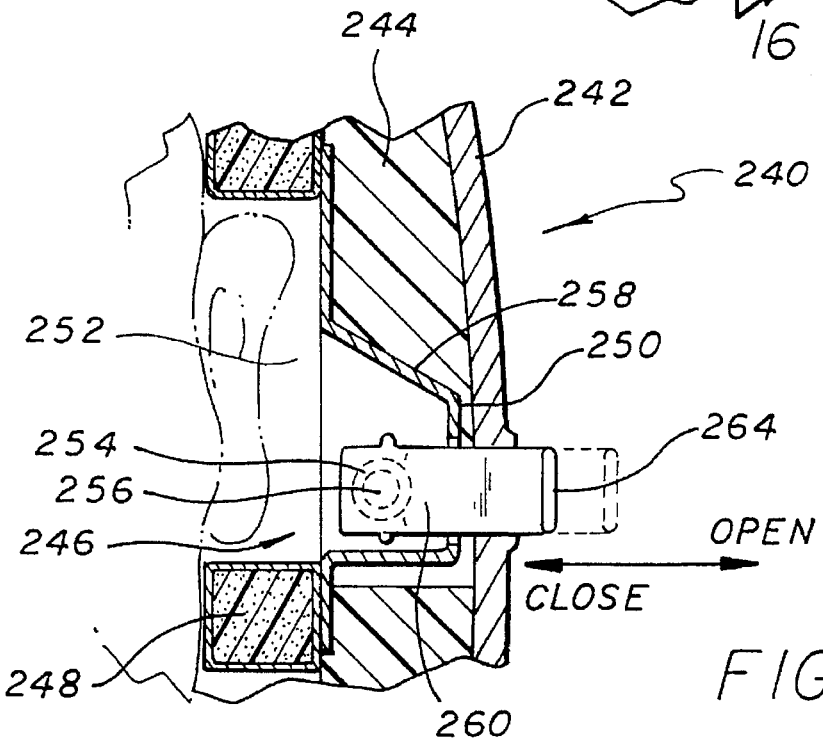
FIG. 16 is an enlarged cross-sectional view taken on line 16—16 of FIG. 15 showing the helmet in position and the operation of the hearing chamber sliding gate.

The user may desire to close off the hearing chamber to the hearing tube because he wants quiet, for example, when he is traveling at high speeds. FIGS. 15 and 16 illustrate generally at 240 a helmet embodiment which provides for such an opening and closing action. Referring thereto the helmet 240 (similar to previously disclosed embodiments) includes a shell (or skirt) 242, a liner 244 and a hearing assembly 246. The hearing assembly 246 in turn includes a cushion ring 248, a cover plate 250, a hearing chamber 252 and a hearing tube 254 communicating at an opening 256 in the cover-plate protruding part 258 with the hearing chamber. A sliding gate 260 passes through corresponding openings in the shell 242 and protruding part 258 into the hearing chamber 252. At the outside end thereof a user grip knob 264 is provided for grasping and sliding the slide member 260 open and closed as shown in FIG. 16. When closed, the slide member 260 blocks the hearing tube opening 256 to the hearing chamber 252. And when opened, it opens it. Alternatively, the sliding gate or similar structure can be provided to shut off the hearing conduit at its outer end on the shell. Although the sliding gate in FIG. 16 is depicted as sliding in from the side, it is also within the scope of this invention to open and close the hearing conduit with an actuator at the bottom of the helmet adjacent the jaw of the user.

The hearing assemblies thus perform the following three functions. (1) Sound isolation. The ear cups form sound tight seals over each of the user's ears and against his head. They comprise any of a number of readily-available sound insulating materials both around his ears and between his ears and the shell. They isolate his ears from annoying and harmful noises generated in and around the helmet shell. (2) Comfort. The ear cups are comprised of any of a number of readily available comfortable materials providing comfort to the user by creating a space that avoids the traditional pressure on his ears caused by its pressing against a helmet interior in the absence of a similarly shaped depressions in the helmet's interior for the user's ear. (3) Efficient sound transference. Useful external sounds are gathered though the shell openings and efficiently directed to his ears.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A helmet positionable in an operative position on a user's head, comprising:

a helmet shell having opposite shell sides, an at least partially open shell front, a shell top, a shell rear, and a shell opening; said helmet shell defining a shell interior;

wherein when in the operative position, said shell sides extend down over the user's ears and said shell open front defines a user through-viewing area; and a hearing assembly attached to and supported by and inside of said helmet shell, said hearing assembly including an ear cup defining an enclosed hearing chamber positioned in said shell interior and a hearing conduit passing through said shell interior and communicating said hearing chamber with said shell opening; said conduit extends rearwardly relative said shell;

wherein when in the operative position, said ear cup fits around one of the user's ears and thereby reduces transmission of undesirable wind noises in, on and around said shell to that ear, and said hearing chamber communicates that ear with the outside of said helmet shell through said conduit and said shell opening such that sounds outside of said shell can be transmitted through said shell opening directed via said conduit to be heard by that ear.

2. The helmet of claim 1 wherein said hearing assembly includes an ear seal which, when in the operative position, fits around the ear and against the user's surrounding head.

3. The helmet of claim 2 wherein said ear seal is on said ear cup.

4. The helmet of claim 2 wherein said ear seal defines a rim of said ear cup.

5. The helmet of claim 2 wherein said ear cup includes an outwardly protruding portion defining therein at least part of said hearing chamber and a cup rim encircling said protruding portion, said cup rim being secured to said ear seal, said ear seal having a central opening in which the user's ear is received, when in the operative position, and said central opening communicating directly with said hearing chamber.

6. The helmet of claim 5 wherein said conduit extends directly out of an opening in said protruding portion.

7. The helmet of claim 5 wherein said cup rim comprises a flat plate.

8. The helmet of claim 2 wherein said ear seal has a central opening which defines at least part of said hearing chamber.

9. The helmet of claim 2 wherein said ear seal comprises a foam-filled O-shaped ring.

10. The helmet of claim 2 wherein said ear seal comprises an oil-filled O-shaped ring, a memory foam ring covered by a material selected from the group consisting of plastic, vinyl and upholstery.

11. The helmet of claim 1 wherein said conduit curves inwardly towards a centerline of the shell as the conduit extends rearwardly.

12. The helmet of claim 1 wherein said conduit comprises a rigid plastic channel.

13. The helmet of claim 1 wherein said conduit is outwardly flaring.

14. The helmet of claim 1 wherein said conduit is cylindrical.

15. The helmet of claim 1 wherein said conduit is outwardly converging.

16. The helmet of claim 1 wherein said conduit is outwardly diverging.

17. The helmet of claim 1 wherein said conduit is horn shaped.

18. The helmet of claim 1 further comprising upholstery disposed in and attached to said helmet shell, and said hearing assembly is attached directly to and suspended by said upholstery and spaced from said helmet shell.

19. The helmet of claim 18 further comprising a crush pad layer between said upholstery and said helmet shell.

20. The helmet of claim 1 further comprising a crush pad layer disposed in and attached to said helmet shell, and said hearing assembly is attached directly to said crush pad layer and suspended therefrom relative to said helmet shell.

21. The helmet of claim 1 wherein said hearing assembly defines a first hearing assembly, and further comprising a second hearing assembly disposed in and supported by said helmet shell for the user's other ear.

22. The helmet of claim 1 further comprising a face shield pivotally attached to said helmet shell and pivotal between operative and raised positions relative to said shell open front.

23. The helmet of claim 1 wherein said shell opening passes through said shell rear.

24. The helmet of claim 1 wherein said shell opening passes through one of said shell sides.

25. The helmet of claim 1 wherein said hearing assembly includes a cushion ring for encircling that ear, and secured to said ear cup a user-contact layer wrapped at least partially around said cushion ring, and a layer of sound-deadening material substantially covering said ear cup.

26. The helmet of claim 25 wherein said user-contact layer comprises a material selected form the group consisting of cloth, vinyl and thin plastic.

27. The helmet of claim 1 further comprising user operable means for selectively closing off said hearing conduit.

28. The helmet of claim 27 wherein said user operable means includes a sliding gate member extendible into said hearing chamber.

29. The helmet of claim 27 wherein said user operable means closes off said hearing conduit directly at said hearing chamber.

30. The helmet of claim 29 wherein said user operable means closes off said hearing conduit at a distal end thereof directly at said shell.

31. A helmet positionable in an operative position on a user's head, comprising:

a helmet shell having opposite shell sides, an at least partially open shell front, a shell top, a shell rear, and a shell opening; said helmet shell defining a shell interior;

wherein when in the operative position, said shell sides extend down over the user's ears and said shell open front defines a user through-viewing area; and a hearing assembly attached to and supported by and inside of said helmet shell, said hearing assembly including an ear cup defining an enclosed hearing chamber positioned in said shell interior and a hearing conduit passing through said shell interior and communicating said hearing chamber with said shell opening;

wherein said hearing assembly includes a ventilation tube for providing ventilating air to that ear, when in the operative position; and wherein when in the operative position, said ear cup fits around one of the user's ears and thereby reduces transmission of undesirable wind noises in, on and around said shell to that ear, and said hearing chamber communicates that ear with the outside of said helmet shell through said conduit and said shell opening such that sounds outside of said shell can be transmitted through said shell opening directed via said conduit to be heard by that ear.

32. The helmet of claim 31 wherein said ventilation tube communicates directly with said hearing chamber.

33. The helmet of claim 31 wherein said ventilation tube is spaced and separate from said hearing conduit.

34. The helmet of claim 31 wherein said ventilation tube has a distal entrance end thereof communicating with an opening in one of said shell sides.

35. The helmet of claim 31 wherein said ventilation tube is disposed with a distal entrance end thereof at said shell open front and disposed forwardly relative to said helmet shell.

36. The helmet of claim 31 wherein said hearing assembly includes opening-and-closing means operable, when in the operative position, by the user for selectively opening and closing said ventilation tube to ventilating air input.

37. The helmet of claim 36 wherein said opening-and-closing means is mounted on said helmet shell.

38. The helmet of claim 36 wherein said opening-and-closing means is mounted on one of said shell sides.

39. The helmet of claim 36 wherein said opening-and-closing means is mounted on said shell open front.

40. The helmet of claim 36 wherein said opening-and-closing means comprises a pivotable shutter.

41. The helmet of claim 36 wherein said opening-and-closing means comprises an axially slidable shutter.

42. A helmet positionable on a user's head, comprising:

a top helmet shell having at least a partially open shell front, a shell top and a shell rear;

a skirt attached to said shell and extendible down over the user's ears, said skirt having a skirt opening; and a hearing assembly attached inside of said skirt, said hearing assembly including an ear cup defining an enclosed hearing chamber and a hearing conduit communicating said hearing chamber with said skirt opening, said conduit extends rearwardly relative said shell; and wherein when said helmet is on the user's head, said ear cup fits around one of the user's ears and reduces transmission of undesirable wind noises to that ear, and said conduit communicates that ear with the outside of the helmet such that sounds can be transmitted and heard by that ear.

43. The helmet of claim 42 further comprising user operable means for selectively closing off said hearing conduit.

44. A helmet positionable in an operative position on a user's head, comprising:

a helmet shell having opposite left and right shell sides, an at least partially open shell front, a shell top, and a shell rear;

wherein when in the operative position, said shell sides extend down over the user's ears and said shell front defines a user through-viewing area;

left and right ear cups supported by and inside of said helmet shell;

wherein when in the operative position, said left and right ear cups fit over the user's left and right ears, respectively, both forming tight seals against the user's head to block the transmission of wind noises to the ears;

a left ventilation tube connected to said left cup to provide ventilating air to the user's left ear, when in the operative position;

a right ventilation tube connected to said right cup to provide ventilating air to the user's right ear, when in the operative position;

a left hearing tube connected to said left cup to allow traffic sounds to reach the user's left ear; when in the operative position, said left hearing tube extending rearwardly relative said shell; and a right hearing tube connected to said right cup to allow traffic sounds to reach the user's right ear; when in the operative position, said right hearing tube extending rearwardly relative said shell.

45. The helmet of claim 44 further comprising opening-and-closing means for opening and closing said left and right ventilation tubes by the user, when in the operative position.

46. The helmet of claim 45 wherein said opening-and-closing means allows said left and right ventilation tubes to be separately and independently opened and closed.

47. The helmet of claim 45 wherein said opening-and-closing means includes a left shutter for said left ventilation tube and a separate right shutter for said right ventilation tube.

48. The helmet of claim 47 wherein said shutters are both mounted to said shell.

49. The helmet of claim 47 wherein said shutters are both pivotal between their open and closed positions.

50. The helmet of claim 47 wherein said shutters are both axially slidable between their open and closed positions.

51. The helmet of claim 44 wherein said left and right ventilation tubes connect to and communicate with openings in said left and right shell sides, respectively.

52. The helmet of claim 44 wherein said left and right ventilation tubes both extend forwardly to said shell front.

* * * * *